United States Patent [19]

Fredenucci

[11] Patent Number: 4,789,430

[45] Date of Patent: Dec. 6, 1988

[54] PAPER SHEET, PROCESS FOR PREPARING SAME AND APPLICATIONS THEREOF PARTICULARLY AS PRODUCT FOR SUBSTITUTING IMPREGNATED GLASS WEBS

[75] Inventor: Pierre Fredenucci, Charavines, France

[73] Assignee: Arjomari-Prioux, Paris, France

[21] Appl. No.: 4,182

[22] Filed: Jan. 16, 1987

Related U.S. Application Data

[63] Continuation of Ser. No. 658,142, Oct. 5, 1984, abandoned.

[30] Foreign Application Priority Data

Oct. 6, 1983 [FR] France ..... 83 15926

[51] Int. Cl.[4] ..... D21H 5/18

[52] U.S. Cl. ..... 162/145; 162/164.1; 162/168.1; 162/169; 162/181.1; 162/183

[58] Field of Search ..... 162/145, 169, 183, 158, 162/168.1, 181.1–181.8, 164.1

[56] References Cited

U.S. PATENT DOCUMENTS

| | | | |
|---|---|---|---|
| 4,274,916 | 6/1981 | Grose | 162/169 |
| 4,373,993 | 2/1983 | Bondoc | 162/169 |
| 4,487,657 | 12/1984 | Gomez | 162/169 |

*Primary Examiner*—Peter Chin

*Attorney, Agent, or Firm*—Bacon & Thomas

[57] ABSTRACT

The invention relates to a paper sheet obtained essentially from (parts by dry weight)

| | | |
|---|---|---|
| "basic mixture" | Fibers (cellulosic and non-cellulosic) | 20 to 40 |
| | Fillers | 80 to 60 |
| | Latex | 40 to 105 |

in particular by a process of double flocculation, which has a very high resistance to delamination. The invention is applicable to floor and wall coverings.

19 Claims, No Drawings

PAPER SHEET, PROCESS FOR PREPARING SAME AND APPLICATIONS THEREOF PARTICULARLY AS PRODUCT FOR SUBSTITUTING IMPREGNATED GLASS WEBS

This application is a continuation of application Ser. No. 658,142, filed Oct. 5, 1984, abandoned.

The present invention relates to the field of products for substituting impregnated glass webs.

More precisely, the invention relates to products in sheet form obtained by paper-making methods, with a high content of latex precipitated in the mass.

Applicants' French Patent Applications Nos. 82 13391 and 82 18624 (corresponding to U.S. patent application Ser. No. 513,432 filed on July 13, 1983), disclose paper sheets with a very high latex content, which may be used as products for substituting impregnated glass webs.

The products described in these Applications are characterized by a very high level of tear strength, both cold and hot.

Moreover, it is very difficult, after for example double-face coating of plasticol (PVC power+plasticizer) followed by a heat treatment at about 160°-200° C., to delaminate the composite product obtained.

Moreover, the product obtained presents a good aptitude to pliability.

These products do not contain fillers, but may contain up to 2/3 by weight of latex.

Furthermore, the man skilled in the art knows that the incorporation of fillers in a product of the type in question considerably reduces the mechanical properties and particularly the resistance to delamination.

As this latter property is essential for the application envisaged (product for substituting impregnated glass webs in applications to floor or wall coverings), this prior knowledge explains the absence of fillers in the formulae described in the above-mentioned Applications.

This prejudice is confirmed by certain simple comparative tests showing that any attempt to incorporate fillers is highly detrimental, particularly to the resistance to delamination.

In this respect, Tables I and II hereinafter show the comparison of typical formulations of the above-mentioned Patent Applications and the same formulations to which attempts have been made to add fillers.

Table I shows the formulations and Table II the results.

The following conclusions, which correspond to the prior knowledge of the man skilled in the art, are drawn from Table II:

The addition of filler leads to a substantial drop in the resistance to delamination.

Moreover, the considerable loss of bulk caused by the addition of this filler largely cancels the economic advantage of this filled composition, for a product which is sold as a function of width.

It has been discovered according to the invention that a certain domain of compositions of fibers, fillers and latex made it possible to obtain products which contain a high percentage of fillers (therefore very economical) but, and this is surprizing, which presents a resistance to delamination at least equal to that of the prior art products.

According to the invention, different compositions have been tested and enable the following limits to be established (parts by dry weight):

| | | |
|---|---|---|
| "basic mixture" ("BM") [basic mixture: 100 parts] | fibers (cellulosic or not) | 20 to 40 |
| | fillers | 80 to 60 |
| | Latex | 40 to 105 |

These limits may fluctuate by reason of the nature of the ingredients of which the product is composed and of the grammage of the products. The variations of these parameters will depend in particular on the application and use of the product both by the manufacturers and by the customers. Mention will be made for example of the necessity to avoid blistering of the layers of polyvinyl chloride deposited by coating, or the necessity of not affecting the mechanical properties.

On reading the present specification and the embodiments, the man skilled in the art will be able to adapt the teaching of the invention to each particular case.

The non-cellulosic fibers will preferably be glass fibers, or other inorganic or synthetic fibers such as rock wool, polyester fibers and like fibers. Their main role is to provide dimensional stability for the support with respect to water and variations in temperature, these two properties being indispensable for the applications envisaged.

Being given that for the applications envisaged the invention seeks a high level of dimensional stability, it is preferable to use cellulosic fibers which have been weakly refined, particularly between 15° and 35° S.R.

In the tests, cellulosic fibers refined to 20° S.R. and glass fibers with a length of about 3 to 4 mm and of 10-11 μm diameter have been used.

However, glass fibers may be used whose length is between 3 and 12 mm, preferably 3 and 6 mm, and with a diameter of between 5 and 15 μm.

A ratio of about 40 to 60 parts by dry weight of inorganic fibers for 100 parts of cellulose fibers will preferably be chosen, particularly when these inorganic fibers are glass fibers whose length is between 4 and 6 mm.

It may be advantageous, in order to increase the formation of the sheet, to use a mixture containing short inorganic fibers. In that case, to obtain the required stability, it will be necessary to increase the quantity of inorganic fibers with respect to the cellulosic fibers. In particular, when these short inorganic fibers are glass fibers of length less than 4 mm, a mixture containing 40 to 90 parts by weight of glass fibers for 100 parts by weight of cellulosic fibers will preferably be chosen.

The man skilled in the art knows that certain chemical treatments of the cellulosic fibers of the support make it possible to improve the dimensional stability (cf. EP Pat. No. 0 018 961 to ROCKWOOL, U.S. Pat. No. 4 291 101 to NIPPON OILS AND FATS or the article in "Papier, Cartons, Films, complexes" of June 1979, page 16, col. 2, para. 2).

Applying such chemical treatments on the support, the man skilled in the art may in particular reduce the quantities of glass fibers necessary for dimensional stability.

A ratio of about 40 to 60 parts by dry weight of inorganic fibers for 100 parts of cellulose fibers will preferably be chosen.

Moreover, to facilitate passage in the wet part of the paper-making machine, it is possible, if necessary (particularly for the compositions with a low content of cellulose or low grammage), to add reinforcing fibers in order to increase the wet mechanical strength. To this end, fibers of polyvinyl alcohol or polyolefins may be used for example in proportions known to the man skilled in the art and corresponding to the desired purpose. Depending on the content of these reinforcing fibers, it is possible to reduce the cellulose content.

The tests made on a large number of latices have shown that vinyl copolymers suited the best.

Suitable results were also obtained with styrene-butadiene copolymers and polymers or copolymers comprising acrylic structural units.

The best results were obtained with the following terpolymer latex (% by weight):

vinylacetate: 54–60
ethylene: 10–16
vinyl chloride: 27–33

The quantity of latex to be introduced in mass depends on the nature of the filler used in the formulation.

The flocculants may be selected from the products of which the list is given in the Patent Applications mentioned above (cf. Table III hereinafter).

Additives known in the paper-making field may also be used in conventional manner: antifoam agents, dyes, sizing, dry, wet resistance, anti-rot agents, etc.

The nature of the flocculants, their dose, as well as the number of places of introduction may vary as a function of the nature of the latex used, of the equipment, of the time of contact between the products; the total dose of the flocculants, which itself depends on the nature of these flocculants (in particular on the molecular weight, ionicity, etc.), will preferably be between 2 and 20 parts by dry weight, for 100 parts by weight of dry latex.

On this subject, the following Tables and the modus operandi hereinafter provide the indications which will enable the man skilled in the art to adapt the technique according to the invention to a variation of these parameters.

The mode of operation corresponding to the tests set forth in Table IV is as follows (additions in that order):

| | | |
|---|---|---|
| fibrous mixture: | | |
| cellulosic fibers of conifers, treated with sodium hydroxide, bleached 20° S.R. | | parts by weight (dry) |
| glass fibers (4.5 mm, 10 μm; "VETROTEX" | | parts by weight (dry) |
| fillers | | parts by weight (dry) |
| flocculant (polyamine/polyamide-epichlorohydrin)[Nadavin LT] [contact time of about 5 mins.] | | parts by weight (dry) |
| latex (cf. Table IV) [contact time of about 5 mins.] | | parts by weight |
| flocculant added after the latex (polyacrylamide of high molecular weight) in two steps (cf. Table I): | | |
| (cf. Table I) | (1) in the chest | $x_1$ parts by weight (dry) |
| | (2) at the head | $x_2$ parts by weight (dry) |

$x_1$ is the quantity necessary for total precipitation. The mixture is then sufficiently stable to be conducted up to the head part of the machine where the last addition of flocculant is effected;
$x_2$ is the percentage by dry weight with respect to the total dry composition.

The compositions used as well as the results of the tests are given in Tables IV or XV hereinafter: of course, these examples have no limiting character.

By a first series of examples, it was sought to show the influence of certain parameters on the physical characteristics of the sheet which are interesting for competing with the impregnated glass web.

It has been observed (Tables VI and VII) that the nature of the inorganic filler used considerably influences the interesting physical characteristics and, in particular, the resistance to delamination of the paper coated on 2 faces.

Thanks to the choice of the filler, it may moreover be envisaged to reduce the quantity of latex introduced in mass without substantially affecting the resistance to delamination of the paper coated on two faces and the dimensional stability (Tables VIII and IX).

The tests show that calcium carbonate is to be used in preference to the other inorganic fillers.

Aluminum hydroxide which gives satisfactory results will suit for manufacturing fire-proof supports.

Other tests (Tables X to XIII; Tables VIII and IX: MP 19454 and 19456) demonstrate the influence of flocculation in the head chest of the machine (addition $3x_2$) on the resistance to delamination of the support coated on two faces.

A second aspect of the tests carried out was to demonstrate that it was possible to approach, and even attain, dimensional stability of the impregnated glass webs, by using compositions with higher glass fiber contents (Tables X, XI, XIV and XV).

It is recalled that another possibility for obtaining better dimensional stability is the chemical treatment of the cellulose of the support by an appropriate size-press which the man skilled in the art can adapt as a function of the absorption of the support and the physical characteristics desired.

Such a treatment therefore makes it possible, for a comparable dimensional stability, to substantially reduce the proportion of glass fibers in the support.

This reduction in the proportion of glass fibers leads to a support presenting a greater density and consequently a better resistance to delamination which makes it possible to envisage a reduction in the latex content.

These tests have also shown that a resistance to delamination of 350 to 400 g/cm for a support coated on two faces rendered the latter sufficiently difficult to delaminate to be substituted for the impregnated glass webs.

These results explain the possibilities of orientation towards formulae less rich in latex.

However, tests MP 19474 and 19487 demonstrate the loss of dimensional stability when the quantity of latex passes from 42.5 parts by weight (MP 19474) to 37 parts by weight (MP 19487) for 100 parts by weight of basic mixture.

The dimensional stability becomes insufficient to envisage satisfactory use of the support to replace the impregnated glass web.

According to the invention, after "step 1" described hereinabove, it is advantageous to effect an additional treatment of "step 2" for the purpose of further improving:

the surface state (elimination of picking or extraction of the glass fibers);
the properties of "barrier" to water, to plasticizers;
anti-rot;
mechanical strength;
rigidity or suppleness, therefore the characteristics of curl or pliability.

To overcome curl of the products coated with plastisol on one face on the front side, a treatment of step 2 may preferably be effected on the reverse side.

These step 2 treatments may be operations of coating, impregnation, surfacing, envisaging the deposit of chemical components on the surface or at the core (by pulverization, size-press, coating machine with blades or rollers, etc.). Particular mention will be made of the addition of latex or plasticizer by size-press.

Heat and/or mechanical treatments may also be effected, such as glazing or cold or hot calendering.

The man skilled in the art knows these techniques and will know how to choose the products to be used as a function of the desired characteristic.

The product will generally be deposited at a rate of 10 to 100 g/m$^2$ (wet state), or 2 to 40 g/m$^2$ after drying (preferably 2 to 20 g/m$^2$) in the case of treatment on one face, and 3 to 60 g/m$^2$ in the case of treatment on both faces.

It may be particularly advantageous here to effect a size-press treatment in order further to improve the resistance to delamination, particularly by adding an appropriate latex which the man skilled in the art will be able to choose as a function of the desired purpose.

PRODUCTS MENTIONED IN THE TABLES

Glass fibers A

VETROTEX fibers with a length of 4.5 mm and diameter 10 μm

Glass fibers B

VETROTEX fibers with a length of 3 mm and diameter 7 μm

Calcium carbonate PR.4

Calcium carbonate of BLANCS MINERAUX DE PARIS mean granulometry: 3 μm

Calcium carbonate OMYALITE 60

Calcium carbonate of OMYA mean granulometry: 1.5 μm

References of the tests

F: Handsheets

MP: Test machines

E: Industrial tests

TABLE I (1) Composition (parts by dry weight):

| | MP 17062 non-filled | MP 17071 filled |
|---|---|---|
| Basic mixture (fibers + filler) | 100 | 140 |
| Fibrous mixture | 100 | 100 |
| of which: cellulose (d) | 69.2 | 69.2 |
| Glass fibers | 30.8 | 30.8 |
| Filler (talc) (*) | 0 | 40 |
| Flocculant No. 1 (a) | 4 | 4 |
| Latex (e) | 100 | 100 |
| Flocculant No. 2 (b) | 1.5 | 1.5 |
| Flocculant No. 3 X (c) (at the head) | 0.4 | 0.4 |
| % Latex/basic mixture | 100% | 71.4% |

| | E 1021 non-filled | E 1043 filled |
|---|---|---|
| Basic mixture (fibers + filler) | 100 | 125 |
| Fibrous mixture | 100 | 100 |
| of which: cellulose (d) | 69.2 | 69.2 |
| of which: glass fiber | 30.8 | 30.8 |
| Filler (talc) | 0 | 25 |
| Flocculant No. 1 (a) | 4 | 4 |
| Latex (e) | 100 | 100 |
| Flocculant No. 2 (b) | 1 | 1 |
| Flocculant No. 3 (c) X | 0.8 | 0.8 |

TABLE I-continued

| % latex/basic mixture | 100% | 80% |
|---|---|---|

Notes:

X % by dry weight with respect to the total dry composition.

Glass fiber: Vitrofil 4 mm

The filler, when it is present, is introduced after the fibers and before flocculant No. 1.

(*) Talc has been used for its particularly attractive cost price, but the man skilled in the art will know how to adapt the process for other inorganic fillers. To this end, reference may be made to the list of examples of fillers shown in Table VI hereinafter.

(a) "Nadavin LT" polyamine/polyamide-epichlorohydrin (b) (c) polyacrylamide of high molecular weight (d) fibers of cellulose of conifers, treated with sodium hydroxide, bleached 25° SR (e) latex: vinyl acetate 54–60
(% by weight) ethylene 10–16
vinyl chloride 27–33 copolymer E: industrial test

TABLE II

| | MP 10762 | MP 17071 | E 1021 | E 1043 |
|---|---|---|---|---|
| Raw paper | | | | |
| Grammage (g/m$^2$) | 225 | 217 | 217 | 241 |
| Thickness (μm) | 361 | 302 | 337 | 354 |
| Bulk (cm$^3$/g) | 1.69 | 1.39 | 1.55 | 1.47 |
| Paper after double-face coating of PVC and gelification at 200° C.: | | | | |
| Resistance to delamination (*) (g/cm) | 400 to 350 | 300 to 350 | 340 | 245 |

(*) Definition valid for the whole of the present Application. Measure by means of a dynamometer expressing the force exerted on 1 cm width to separate in its mass the support previously coated with PVC on its two faces, with incipient cleavage in the mass of the support.

TABLE III

Flocculating agents or precipitants

| References | Type of flocculants or precipitants |
|---|---|
| P 1 | Aluminium sulfate |
| P 2 | Aluminium polychloride |
| P 3 | Sodium and calcium aluminate |
| P 4 | Mixture of polyacrylic acid and of polyacrylamide in 5–30% solution (weight/volume) |
| P 5 | Polyethyleneimine in 2–50% solution (weight/volume) |
| P 6 | Copolymer of acrylamide and β-methacrylyloxyethyltrimethylammonium methylsulfate |
| P 7 | Polyamine-epichlorohydrin resin and diamine-propylmethylamine in 2–50% solution |
| P 8 | Polyamide-epichlorohydrin resin manufactured from epichlorohydrin, adipic acid, caprolactam, diethylenetriamine and/or ethylenediamine, in 2–50% solution |
| P 9 | Polyamide-polyamine-epichlorohydrin resin manufactured from epichlorohydrin, dimethyl ester, adipic acid and diethylenetriamine, in 2–50% solution |
| P 10 | Polyamide-epichlorohydrin resin manufactured from epichlorohydrin, diethylenetriamine, adipic acid and ethyleneimine |
| P 11 | Polyamide-epichlorohydrin resin manufactured from adipic acid, diethylenetriamine and a mixture of epichlorohydrin and dimethylamine in 2–50% solution |
| P 12 | Cationic polyamide-polyamine resin manufactured from triethylenetriamine |
| P 13 | Products of condensation of aromatic sulfonic acids with formaldehyde |
| P 14 | Aluminium acetate |
| P 15 | Aluminium formate |
| P 16 | Mixture of aluminium acetate, sulfate and formate |

N.B.: When it is question of solutions, these are aqueous solutions.

TABLE IV

Examples of formulations according to the invention

| Test | MP 17843 | MP 18122 | MP 18097 |
|---|---|---|---|
| | Basic mixture | | |

TABLE IV-continued

| Test | MP 17843 | MP 18122 | MP 18097 |
|---|---|---|---|
| Examples of formulations according to the invention | | | |
| Cellulose fibers (parts by dry weight) | 13.5 (1) | 17.5 (1) | 23.2 (1) |
| Non-cellulosic fibers (parts by dry weight) | 7.5 (2) | 9.7 (2) | 14.0 (2) |
| Fillers (parts by dry weight) | 79 (3) | 72.8 (3) | 62.8 (3) |
| Latex (parts by dry weight) | 56.4 (4) | 72.8 (4) | 104.7 (4) |
| Flocculants | | | |
| addition 1 (parts by dry weight) | 2 | 2.5 | 3.5 |
| addition 2 ($x_1$) (parts by dry weight) | 0.3 | 0.36 | 0.52 |
| addition 3 ($x_2$) (5) | 0.25 | 0.5 | 0.7 |

Notes:
(1) Cellulose fibers of conifers, treated with sodium hydroxide, bleached, refined to 20° SR
(2) Glass fibers "A"
(3) Talc
(4) Latex terpolymer: vinyl acetate/ethylene/vinyl chloride
(5) % dry weight with respect to the total dry composition.

TABLE VI

| Test | MP 19069 | MP 18713 | MP 18253 |
|---|---|---|---|
| Examples of formulations according to the invention | | | |
| | Basic mixture = 100 | | |
| Cellulose fibers (parts by dry weight) | 17.6 (1) | 17.6 (1) | 17.6 (1) |
| Non-cellulosic fibers (parts by dry weight) | 9.1 (2) | 9.1 (2) | 9.1 (2) |
| Fillers (parts by dry weight) | 73.3 (3) | 73.3 (6) | 73.3 (7) |
| Latex (parts by dry weight) | 73.3 (4) | 73.3 (4) | 73.3 (4) |
| Flocculants | | | |
| addition 1 (parts by dry weight) | 2.4 | 2.4 | 2.4 |
| addition 2 ($x_1$) (parts by dry weight) | 0.37 | 0.37 | 0.37 |
| addition 3 ($x_2$) (5) | 0.6 | 0.5 | 0.3 |

Notes:
(1) Cellulose fibers of conifers, treated with sodium hydroxide, bleached, refined to 20° SR
(2) Glass fibers "A"
(3) Calcium carbonate PR4
(4) Latex terpolymer: vinyl acetate/ethylene/vinyl chloride
(5) % by dry weight with respect to the total dry composition.

TABLE V

| Tests | MP 17843 | MP 18122 | MP 18097 |
|---|---|---|---|
| Properties of the products obtained from the formulations | | | |
| Characteristics: | | | |
| Raw papers (without stoving) | | | |
| grammage (g/m$^2$) | 452 | 312 | 296 |
| thickness (μm) | 495 | 369 | 451 |
| bulk (cm$^3$/g) | 1.09 | 1.18 | 1.52 |
| Papers coated with PVC | | | |
| on 1 face Resistance to delamination (g/cm) | indelaminable | indelaminable | indelaminable |
| on 2 faces Resistance to delamination (g/cm) | >500 | >500 | indelaminable |
| Paper stoved for 2 mins. at 200° C. | | | |
| pliability | good | good | good |
| dimensional stability in water for 8 mins. cross direction | 0.10% | 0.13% | 0.10% |
| stability to humidity | | | |
| Elongation in cross direction between 15 and 65% | 0.06% | 0.07% | 0.07% |
| Elongation in cross direction between 15 and 95% | 0.16% | 0.17% | 0.19% |

(6) Aluminium hydroxide
(7) Talc

TABLE VII

| Tests | MP 19069 | MP 18713 | MP 18253 |
|---|---|---|---|
| Properties of the products obtained from the formulations | | | |
| Characteristics: | | | |
| Raw papers (without stoving) | | | |
| grammage (g/m$^2$) | 314 | 284 | 284 |
| thickness (μm) | 330 | 319 | 301 |
| bulk (cm$^3$/g) | 1.05 | 1.12 | 1.05 |
| Papers coated with PVC | | | |
| on 1 face Resistance to delamination (g/cm) | indelaminable | indelaminable | indelaminable |
| on 2 faces Resistance to delamination (g/cm) | >1000 | 900 | 580 |
| Paper stoved for 2 mins. at 200° C. | | | |
| pliability | good | good | good |
| dimensional stability in water for 8 mins. cross direction | 0.10% | 0.08% | 0.10% |
| stability to humidity | | | |
| Elongation in cross direction between 15 and 65% | 0.08% | 0.07% | 0.10% |
| Elongation in cross direction between 15 and 95% | 0.16% | 0.14% | 0.17% |

TABLE VIII

| Test | Examples of formulations according to the invention | | | | | |
|---|---|---|---|---|---|---|
| | MP 19069 | MP 19077 | MP 19454 | MP 19456 | MP 19474 | MP 19487 |
| | basic mixture = 100 | | | | | |
| Cellulose fibers (parts by dry weight) | 17.6 (1) | 17.6 (1) | 17.6 (1) | 17.6 (1) | 17.6 (1) | 17.6 (1) |
| Non-cellulosic fibers (parts by dry weight) | 9.1 (2) | 9.1 (2) | 9.1 (2) | 9.1 (2) | 9.1 (2) | 9.1 (2) |
| Fillers (parts by weight) | 73.3 (3) | 73.3 (3) | 73.3 (6) | 73.3 (6) | 73.3 (6) | 73.3 (6) |
| Latex (parts by dry weight) | 73.3 (4) | 61.1 (4) | 48.9 (4) | 48.9 (4) | 42.8 (4) | 37 (4) |
| Flocculants | | | | | | |
| addition 1 (parts by dry weight) | 2.4 | 2.4 | 2.4 | 2.4 | 1.7 | 1.2 |
| addition 2 ($x_1$) (parts by dry weight) | 0.37 | 0.37 | 0.27 | 0.27 | 0.27 | 0.19 |
| addition 3 ($x_2$) (5) | 0.6 | 0.5 | 0.6 | 0.3 | 0.4 | 0.3 |

Notes:
(1) Cellulose fibers of conifers, treated with sodium hydroxide, bleached, refined to 20° SR
(2) Glass fibers VETROTEX
(3) Calcium carbonate PR4
(4) Latex terpolymer: vinyl acetate/ethylene/vinyl chloride
(5) % by dry weight with respect to the total dry composition.
(6) Calcium carbonate OMYALITE 60

TABLE IX

| Tests | Properties of the products obtained from the formulations | | | | | |
|---|---|---|---|---|---|---|
| | MP 19069 | MP 19077 | MP 19454 | MP 19456 | MP 19474 | MP 19487 |
| Characteristics: | | | | | | |
| Raw papers (without stoving) | | | | | | |
| grammage (g/m$^2$) | 314 | 302 | 258 | 284 | 280 | 273 |
| thickness (μm) | 330 | 298 | 302 | 318 | 314 | 288 |
| bulk (cm$^3$/g) | 1.05 | 1.00 | 1.17 | 1.11 | 1.12 | 1.05 |
| Papers coated with PVC | | | | | | |
| on 1 face Resistance to delamination (g/cm) | indelaminable | indelaminable | indelaminable | indelaminable | indelaminable | indelaminable |
| on 2 faces Resistance to delamination (g/cm) | indelaminable (>1000) | indelaminable (>1000) | indelaminable (>1000) | 450 | 620 | 520 |
| Paper stoved for 2 mins. at 200° C. | | | | | | |
| pliability | good | good | good | good | good | good |
| dimensional stability in water for 8 mins. cross direction | 0.10% | 0.12% | 0.10% | 0.09% | 0.10% | |
| stability to humidity | | | | | | |
| Elongation in cross direction between 15 and 65% | 0.08% | 0.10% | 0.10% | 0.11% | 0.10% | 0.14% |
| Elongation in cross direction between 15 and 95% | 0.16% | 0.20% | 0.18% | 0.18% | 0.17% | 0.22% |

TABLE X

| Test | Examples of formulations according to the invention | | |
|---|---|---|---|
| | MP 19377 | MP 19378 | MP 19379 |
| | Basic mixture = 100 | | |
| Cellulose fibers (parts by dry weight) | 16.5 (1) | 16.5 (1) | 16.5 (1) |
| Non-cellulosic fibers (parts by dry weight) | 15 (2) | 15 (2) | 15 (2) |
| Fillers (parts by dry weight) | 68.5 (3) | 68.5 (3) | 68.5 (3) |
| Latex (parts by dry weight) | 57.1 (4) | 57.1 (4) | 57.1 (4) |
| Flocculants | | | |
| addition 1 (parts by dry weight) | 2.3 | 2.3 | 2.3 |
| addition 2 ($x_1$) (parts by dry weight) | 0.34 | 0.34 | 0.34 |
| addition 3 ($x_2$) (5) | 0.5 | 0.6 | 0.4 |

Notes:
(1) Cellulose fibers of conifers, treated with sodium hydroxide, bleached, refined to 20° SR
(2) Mixture of glass fibers VETROTEX in commercial weight ½ A + ½ B
(3) Calcium carbonate (OMYALITE 60)
(4) Latex terpolymer: vinyl acetate/ethylene/vinyl chloride
(5) % by dry weight with respect to the total dry composition.

TABLE XI

| Tests | Properties of the products obtained from the formulations | | |
|---|---|---|---|
| | MP 19377 | MP 19378 | MP 19379 |
| Characteristics: | | | |
| Raw papers (without stoving) | | | |
| grammage (g/m$^2$) | 285 | 294 | 286 |
| thickness (μm) | 298 | 305 | 315 |
| bulk (cm$^3$/g) | 1.04 | 1.03 | 1.10 |
| Papers coated with PVC | | | |
| on 1 face | indelaminable | indelaminable | indelaminable |

TABLE XI-continued

| Tests | Properties of the products obtained from the formulations | | |
|---|---|---|---|
| | MP 19377 | MP 19378 | MP 19379 |
| Resistance to delamination (g/cm) on 2 faces | 730 | 700 | 800 |
| Resistance to delamination (g/cm) | | | |
| Paper stoved for 2 mins. at 200° C. | | | |
| pliability | good | good | good |
| dimensional stability in water for 8 mins. cross direction | <0.08% | <0.08% | <0.08% |
| stability to humidity | | | |
| Elongation in cross direction between 15 and 65% | 0.065% | 0.055% | 0.06% |
| Elongation in cross direction between 15 and 95% | 0.12% | 0.10% | 0.11% |

TABLE XII

| Test | Examples of formulations according to the invention | | | |
|---|---|---|---|---|
| | F270884/1A | F270884/1B | F300884/1A | F300884/1B |
| | basic mixture = 100 | | | |
| Cellulose fibers (parts by dry weight) | 16.5 (1) | 16.5 (1) | 18.1 (1) | 18.1 (1) |
| Non-cellulosic fibers (parts by dry weight) | 14.7 (2) | 14.7 (2) | 16.1 (2) | 16.1 (2) |
| Fillers (parts by dry weight) | 68.8 (3) | 68.8 (3) | 65.8 (3) | 65.8 (3) |
| Latex (parts by dry weight) | 57.3 (4) | 57.3 (4) | 53.3 (4) | 53.3 (4) |
| Flocculants | | | | |
| addition 1 (parts by dry weight) | 2.3 | 2.3 | 2.5 | 2.5 |
| addition 2 ($x_1$) (parts by dry weight) | 0.34 | 0.34 | 0.37 | 0.37 |
| addition 3 ($x_2$) (5) | 0.75 | 0.875 | 0.75 | 0.875 |

Notes:
(1) Cellulose fibers of conifers, treated with sodium hydroxide, bleached, refined to 20° SR
(2) Mixture of glass fibers VETROTEX $\frac{1}{3}$ A + $\frac{2}{3}$ B
(3) Calcium carbonate OMYALITE 60
(4) Latex terpolymer: vinyl acetate/ethylene/vinyl chloride
(5) % by dry weight with respect to the total dry composition.

TABLE XIII

| Tests | Properties of the products obtained from the formulations | | | |
|---|---|---|---|---|
| | F270884/1A | F270884/1B | F300884/1A | F300884/1B |
| Characteristics: | | | | |
| Raw papers (without stoving) | | | | |
| grammage (g/m$^2$) | 257 | 265 | 256 | 261 |
| thickness (μm) | 271 | 271 | 285 | 277 |
| bulk (cm$^3$/g) | 1.05 | 1.02 | 1.11 | 1.06 |
| Papers coated with PVC | | | | |
| on 1 face | indelaminable | indelaminable | indelaminable | indelaminable |
| Resistance to delamination (g/cm) on 2 faces | 400 | indelaminable | 440 | indelaminable |
| Resistance to delamination (g/cm) | | | | |
| Paper stoved for 2 mins. at 200° C. | | | | |
| pliability | good | good | good | good |
| dimensional stability in water for 8 mins. cross direction | — | — | — | — |
| stability to humidity | | | | |
| Elongation in cross direction between 15 and 65% | — | — | — | — |
| Elongation in cross direction between 15 and 95% | — | — | — | — |

TABLE XIV

| Test | Examples of formulations according to the invention | | | |
|---|---|---|---|---|
| | MP 19163 | MP 19377 | E 1153 | E 1145 |
| | Basic mixture = 100 | | | |
| Cellulose fibers (parts by dry weight) | 15.7 (1) | 16.5 (1) | 16.5 (1) | 16.5 (1) |
| Non-cellulosic fibers (parts by dry weight) | 18.9 (2) | 15 (2) | 14.6 (6) | 14.6 (7) |
| Fillers (parts by dry weight) | 65.4 (3) | 68.5 (3) | 68.9 (3) | 68.9 (3) |
| Latex (parts by dry weight) | 54.5 (4) | 57.1 (4) | 57.4 (4) | 57.4 (4) |
| Flocculants | | | | |

TABLE XIV-continued

| Test | Examples of formulations according to the invention | | | |
|---|---|---|---|---|
| | MP 19163 | MP 19377 | E 1153 | E 1145 |
| addition 1 (parts by dry weight) | 2.2 | 2.3 | 2.3 | 2.3 |
| addition 2 ($x_1$) (parts by dry weight) | 0.33 | 0.34 | 0.34 | 0.34 |

TABLE XIV-continued

| Test | Examples of formulations according to the invention | | | |
|---|---|---|---|---|
| | MP 19163 | MP 19377 | E 1153 | E 1145 |
| addition 3 ($x_2$) (5) | 0.6 | 0.5 | 0.4 | 0.5 |

Notes:
(1) Cellulose fibers of conifers, treated with sodium hydroxide, bleached, refined to 20° SR
(2) Glass fibers VETROTEX: mixture in commercial weight ½ A + ½ B
(3) Calcium carbonate OMYALITE 60
(4) Latex terpolymer: vinyl acetate/ethylene/vinyl chloride
(5) % by dry weight with respect to the total dry composition.
(6) Glass fibers VETROTEX: mixture in commercial weight ⅓ A + ⅔ B
(7) Glass fibers VETROTEX: B

TABLE XV

| Tests | Properties of the products obtained from the formulations | | | |
|---|---|---|---|---|
| | MP 19163 | MP 19377 | 3 1153 | E 1145 |
| Characteristics: | | | | |
| Raw papers (without stoving) | | | | |
| grammage (g/m²) | 205 | 285 | 286 | 275 |
| thickness (μm) | 261 | 298 | 288 | 300 |
| bulk (cm³/g) | 1.27 | 1.04 | 1.00 | 1.09 |
| Papers coated with PVC | | | | |
| on 1 face Resistance to delamination (g/cm) | indelaminable | indelaminable | indelaminable | indelaminable |
| on 2 faces Resistance to delamination (g/cm) | 515 | 730 | 495 | 450 |
| Paper stoved for 2 mins. at 200° C. | | | | |
| pliability | good | good | good | good |
| dimensional stability in water for 8 mins. cross direction | <0.08% | <0.08% | <0.08% | <0.08% |
| stability to humidity | | | | |
| Elongation in cross direction between 15 and 65% | 0.06% | 0.065% | 0.07% | 0.07% |
| Elongation in cross direction between 15 and 95% | 0.11% | 0.12% | 0.13% | 0.13% |

TABLE XVI

INORGANIC FILLERS WHICH MAY BE USED

| References | Type of filler |
|---|---|
| C1 | Talc: Complex magnesium silicate - particles of 1 to 50 μm, preferably 2 to 50 μm - specific weight from 2.7 to 2.8 |
| C2 | Kaolin: Complex aluminium hydrate silicate - particles of 1 to 50 μm, preferably 2 to 50 μm - specific weight 2.58 |
| C3 | Natural calcium carbonate: particles of 1.5 to 20 μm, preferably 2 to 20 μm - specific weight: 2.7 |
| C4 | Precipitated calcium carbonate: particles of 1.5 to 20 μm, preferably 2 to 20 μm - specific weight: 2.7 |
| C5 | Natural barium sulfate: particles of 2 to 50 μm- specific weight about 4.4–4.5 |
| C5 | Precipitated barium sulfate: particles 2 to 20 μm - specific weight about 4.35 |
| C6 | Silica of diatoms: particles of 2 to 50 μm - specific weight about 2 to 2.3 |
| C7 | White satin: hydrated calcium sulfoaluminate |
| C8 | Natural calcium sulfate: particles of 2 to 50 μm - specific weight about 2.32–2.96 |
| C9 | Aluminium hydroxide: particles of 2 to 50 μm |
| C10 | Sodium and calcium aluminate: particles of 1 to 20 μm - specific weight 2.2 |
| C11 | Sodium silicoaluminate: particles of 1 to 20 μm - specific weight about 2.12 |
| C12 | Rutile titanium: particles of 0.5 to .10 μm - specific weight about 4.2 |
| C13 | Octahedrite titanium: particles of 0.5 to 10 μm - specific weight about 3.9 |
| C14 | Mixtures C1–C6 (70:30) by weight |
| C15 | Mixture C1–C3 (50:50) by weight |
| C17 | Mixture C1–C12 (95:5) by weight |
| C18 | Magnesium hydroxide: particles of 2 to 50 μm |

Note: The specific weight is expressed in g/ml.

What is claimed is:

1. A paper sheet which contains, in parts by dry weight, 40 to 105 parts of latex and 100 parts of a basic mixture comprising 60 to 40 parts of cellulosic fibers having an SR of 15–35 and non-cellulosic fibers including short inorganic fibers, said short inorganic fibers being glass fibers and representing 40 to 90% by dry weight of said cellulosic fibers, and said sheet having a dimensional stability of not more than 0.13%, and a resistance to delamination of greater than 350 g/cm, and wherein the fillers or flocculant are not calcium hydroxide.

2. The paper sheet of claim 1, wherein the inorganic fibers are glass fibers having a length of less than 4 mm.

3. The paper sheet of claim 1 wherein the fillers are inorganic fillers selected from the group consisting of talc, kaolin, calcium carbonate, barium sulfate, silica of diatoms, satin white, calcium sulfate, aluminum hydroxide, sodium aluminate, calcium aluminate, sodium silicoaluminate, rutile, octahedrite, magnesium hydroxide and mixtures thereof.

4. A paper sheet which contains, in parts by dry weight; 40 to 105 parts of latex and 100 parts of a basic mixture comprising 60 to 80 parts of fillers and 20 to 40 parts of cellulosic fibers having a SR of 15–35 and non-cellulosic fibers, said non-cellulosic fibers being glass fibers and representing 40 to 60% by dry weight of said cellulosic fibers, said sheet having a dimensional stability of not more than 0.13% and a resistance to delamination of greater than 350 g/cm, and wherein said sheet does not contain calcium hydroxide as a flocculant or filler.

5. The sheet of claim 4, wherein said non-cellulosic fibers are glass fibers or rock wool.

6. The sheet of claim 4, wherein said non-cellulosic fibers are glass fibers.

7. The sheet of claim 6, wherein said glass fibers have a length of between about 3 and 12 mm, and a diameter of about 5 to 15 μm.

8. The sheet of claim 6 wherein said glass fibers have a length of between about 3 and 6 mm and a diameter of about 5 to 15 μm.

9. The sheet of claim 6, wherein the latex is selected from styrene-butadiene copolymers, acrylic and preferably vinyl latices.

10. The sheet of claim 9, wherein the latex is a terpolymer of vinyl acetate, ethylene and vinyl chloride.

11. The sheet of claim 6, wherein the filler is selected from calcium carbonate and aluminum hydroxide.

12. The paper sheet of claim 4 wherein the fillers are inorganic fillers selected from the group consisting of talc, kaolin, calcium carbonate, barium sulfate, silica of diatoms, satin white, calcium sulfate, aluminum hydroxide, sodium aluminate, calcium aluminate, sodium silicoaluminate, rutile, octahedrite, magnesium hydroxide and mixtures thereof.

13. A process for manufacturing a paper sheet having a dimensional stability of not more than 0.13% and a resistance to delamination of at least 350 g/cm, in a paper-making machine having a headbox downstream of a chest, said process comprising the steps of preparing an aqueous dispersion by adding successively the following components;

20 to 40 parts by dry weight of a fibrous mixture comprising cellulosic fibers refined between 15 and 35 SR and glass fibers in a content representing 40–60% in weight of said cellulosic fibers;

60 to 80 parts by dry weight of fillers so as to obtain 100 parts of a basic mixture containing said fibrous mixture and said fillers;

a first addition of a flocculating amount of flocculant;

40 to 105 parts by dry weight of latex selected from acrylic and preferably vinyl styrene-butadiene copolymers, particularly vinyl chloride/ethylene/vinyl acetate copolymer or plasticized acrylate/vinyl chloride copolymer;

a second addition of a flocculating amount of flocculant in said chest; and a third addition of a flocculating amount of flocculant in said headbox, and of passing said aqueous dispersion on said paper-making machine and wherein calcium hydroxide is not used as the filler or the flocculant.

14. The process of claim 13, wherein said sheet undergoes at least one further treatment selected from operations of coating, impregnation, surfacing, glazing, cold or hot calendering.

15. The process of claim 13, wherein said aqueous dispersion comprises in parts by dry weight:

100 parts of a basic mixture made by mixing:
17.6 parts of cellulose fibers
9.1 parts of glass fibers
73.3 parts of calcium carbonate;
61.5 parts of latex terpolymer of vinyl acetate/ethylene/vinyl chloride;
2.4 parts of said first addition of flocculant;
0.37 parts of said second addition of flocculant;
0.5% of said third addition of flocculant by dry weight with respect to the total dry weight.

16. The process of claim 13, wherein said aqueous dispersion comprises in parts by dry weight:

100 parts of a basic mixture made by mixing:
17.6 parts of cellulose fibers
9.1 parts of glass fibers
73.3 parts of calcium carbonate;
42.8 parts of latex terpolymer of vinyl acetate/ethylene/vinyl chloride;
1.7 parts of said first addition of flocculant;
0.27 parts of said second addition of flocculant;
0.4% of said third addition of flocculant by dry weight with respect to the total dry weight.

17. The process of claim 13, wherein said aqueous dispersion comprises in parts by dry weight:

100 parts of a basic mixture made by mixing:
16.5 parts of cellulose fibers
14.6 parts of glass fibers
68.9 parts of calcium carbonate;
57.4 parts of latex terpolymer of vinyl acetate/ethylene/vinyl chloride;
2.3 parts of said first addition of flocculant;
0.34 parts of said second addition of flocculant;
0.4% of said third addition of flocculant by dry weight with respect to the total dry weight.

18. The process of claim 13, wherein said aqueous dispersion comprises in parts by dry weight:

100 parts of a basic mixture made by mixing:
16.5 parts of cellulose fibers
14.6 parts of glass fibers
68.9 parts of calcium carbonate;
57.4 parts of latex terpolymer of vinyl acetate/ethylene/vinyl chloride;
2.3 parts of said first addition of flocculant;
0.34 parts of said second addition of flocculant;
0.5% of said third addition of flocculant by dry weight with respect to the total dry weight.

19. The process of claim 13 wherein the fillers are inorganic fillers selected from the group consisting of talc, kaolin, calcium carbonate, barium sulfate, silica of diatoms, satin white, calcium sulfate, aluminum hydroxide, sodium aluminate, calcium aluminate, sodium silicoaluminate, rutile, octahedrite, magnesium hydroxide and mixtures thereof.

* * * * *